US005881991A

United States Patent [19]

Bonin

[11] Patent Number: 5,881,991

[45] Date of Patent: Mar. 16, 1999

[54] MOUNT ASSEMBLY FOR OUTBOARD MOTOR FRAME

[76] Inventor: Nelson J. Bonin, 1198 Bayou Portage Rd., St. Martinsville, La. 70582

[21] Appl. No.: 908,366

[22] Filed: Aug. 7, 1997

[51] Int. Cl.[6] ..... F16M 3/00

[52] U.S. Cl. ..... 248/640; 440/900

[58] Field of Search ..... 248/640, 641, 248/642, 643; 403/260, 256; 440/52, 900

[56] References Cited

U.S. PATENT DOCUMENTS

| | | | |
|---|---|---|---|
| 3,251,333 | 5/1966 | Smith | 248/642 X |
| 4,955,963 | 9/1990 | Snyder | 248/640 |
| 5,180,319 | 1/1993 | Shiomi et al. | 248/640 X |
| 5,188,548 | 2/1993 | Ferguson et al. | 440/61 |
| 5,192,235 | 3/1993 | Dunham et al. | 440/52 |
| 5,224,888 | 7/1993 | Fujimoto et al. | 248/641 X |
| 5,234,362 | 8/1993 | Breckenfield et al. | 440/76 |

*Primary Examiner*—Ramon O. Ramirez

*Attorney, Agent, or Firm*—Joseph N. Breaux

[57] ABSTRACT

A mount assembly for an outboard motor frame of the type that includes two mount assembly fittings each having a bolt on fitting cover and a channeled fitting plate is provided. The mount assembly includes a threaded mounting bolt having a bolt shaft having a threaded end, an interior tubular bushing having a shaft passageway sized to receive a portion of the bolt shaft, a helically coiled compression spring of a length longer than the interior tubular bushing and sized to pass over the interior tubular bushing, an outer bushing having a bushing passageway having a bushing passageway diameter sufficient to allow the compression spring to be positioned into the bushing passageway and an exterior bushing diameter sized to allow the outer bushing to fit into the mount assembly fitting, the outer bushing having a locking groove formed into the exterior thereof, a spring compression washer having a washer diameter less than the bushing passageway diameter and a center washer hole sized to allow passage of the bolt shaft, and a mounting nut companionately threaded to thread onto the threaded end of the bolt shaft.

18 Claims, 3 Drawing Sheets

MOUNT ASSEMBLY FOR OUTBOARD MOTOR FRAME

TECHNICAL FIELD

The present invention relates to mounting assemblies and more particularly to a mount assembly for outboard motor frames of the type that include two mount assembly fittings each having a bolt on fitting cover and a channeled fitting plate; the mount assembly including a threaded mounting bolt having a bolt shaft having a threaded end, an interior tubular bushing having a shaft passageway sized to receive a portion of the bolt shaft, a helically coiled compression spring of a length longer than the interior tubular bushing and sized to pass over the interior tubular bushing, an outer bushing having a bushing passageway having a bushing passageway diameter sufficient to allow the compression spring to be positioned into the bushing passageway and an exterior bushing diameter sized to allow the outer bushing to fit into the mount assembly fitting, the outer bushing having a locking groove formed into the exterior thereof, a spring compression washer having a washer diameter less than the bushing passageway diameter and a center washer hole sized to allow passage of the bolt shaft, and a mounting nut companionately threaded to thread onto the threaded end of the bolt shaft.

BACKGROUND OF THE INVENTION

Outboard motors are subject to environments that can rapidly degrade the rubber and plastic portions of conventional mount assemblies used to mount the outboard motor frame to the boat transom bracket. It would be a benefit, therefore, to have a mount assembly for outboard motor frames that did not include any plastic or rubber parts. Because replacing the mount assemblies can take considerable labor, it would be a benefit to have a mount assembly that was durable.

SUMMARY OF THE INVENTION

It is thus an object of the invention to provide a mount assembly for an outboard motor frame that does not include any plastic or rubber parts.

It is a further object of the invention to provide a mount assembly for an outboard motor frame that is durable.

It is a still further object of the invention to provide a mount assembly for an outboard motor frame of the type that includes two mount assembly fittings each having a bolt on fitting cover and a channeled fitting plate; the mount assembly including a threaded mounting bolt having a bolt shaft having a threaded end, an interior tubular bushing having a shaft passageway sized to receive a portion of the bolt shaft, a helically coiled compression spring of a length longer than the interior tubular bushing and sized to pass over the interior tubular bushing, an outer bushing having a bushing passageway having a bushing passageway diameter sufficient to allow the compression spring to be positioned into the bushing passageway and an exterior bushing diameter sized to allow the outer bushing to fit into the mount assembly fitting, the outer bushing having a locking groove formed into the exterior thereof, a spring compression washer having a washer diameter less than the bushing passageway diameter and a center washer hole sized to allow passage of the bolt shaft, and a mounting nut companionately threaded to thread onto the threaded end of the bolt shaft.

It is a still further object of the invention to provide a mount assembly for an outboard motor frame that accomplishes some or all of the above objects in combination.

Accordingly, a mount assembly for an outboard motor frame of the type that includes two mount assembly fittings each having a bolt on fitting cover and a channeled fitting plate is provided. The mount assembly includes a threaded mounting bolt having a bolt shaft having a threaded end, an interior tubular bushing having a shaft passageway sized to receive a portion of the bolt shaft, a helically coiled compression spring of a length longer than the interior tubular bushing and sized to pass over the interior tubular bushing, an outer bushing having a bushing passageway having a bushing passageway diameter sufficient to allow the compression spring to be positioned into the bushing passageway and an exterior bushing diameter sized to allow the outer bushing to fit into the mount assembly fitting, the outer bushing having locking groove formed into the exterior thereof, a spring compression washer having a washer diameter less than the bushing passageway diameter and a center washer hole sized to allow passage of the bolt shaft, and a mounting nut companionately threaded to thread onto the threaded end of the bolt shaft.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

DESCRIPTION OF THE EXEMPLARY EMBODIMENT

Figure 1:
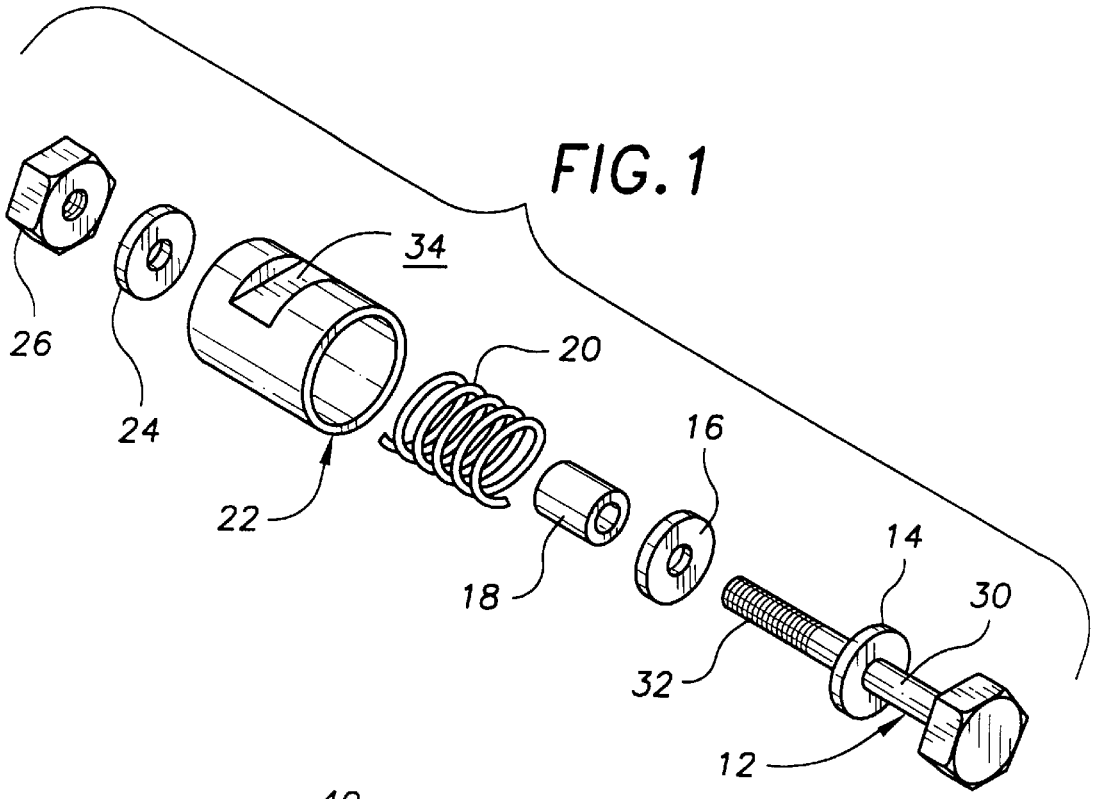
FIG. 1 is an exploded perspective view of the mount assembly for outboard motor frame of the present invention showing the threaded mounting bolt, the transom washer, the frame washer, the interior tubular bushing, the compression spring, the outer bushing with the locking groove, the spring compression washer, and the mounting nut.

FIG. 1 shows an exemplary embodiment of the mount assembly for outboard motor frame of the present invention generally designated by the numeral 10. Mount assembly 10 includes a threaded mounting bolt, generally designated 12; a transom washer 14; a frame washer 16; a interior tubular bushing 18; a helical coiled compression spring 20; an outer bushing, generally designated 22; a spring compression washer 24; and a mounting nut 26. Threaded mounting bolt 12 is a conventional stainless steel bolt that has a bolt shaft 30 with a threaded end 32. Transom washer 14, frame washer 16, and spring compression washer 24 are identically sized, conventional stainless steel washers. Interior tubular bushing 18 and outer bushing 22 are each constructed of stainless steel. Outer bushing 22 is longer in length than interior tubular bushing 18 and is provided with locking groove 34 machined into the exterior surface thereof. Helical coiled compression spring 20 is a convention compression spring having an uncompressed length greater than the length of bushing 22.

Figure 1A:
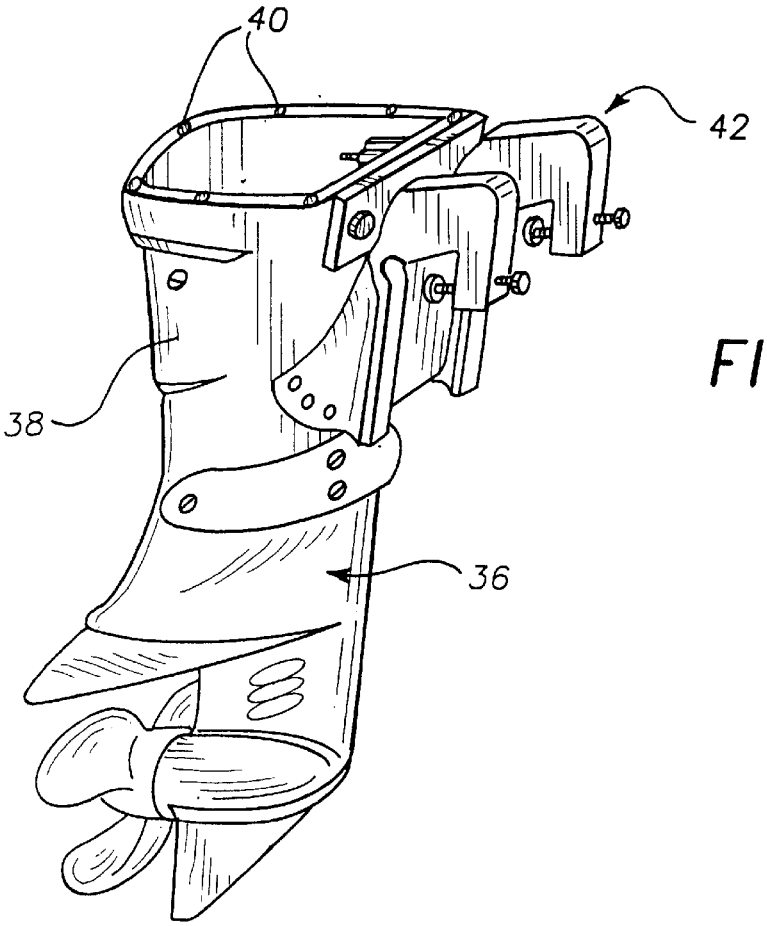
FIG. 1A is a perspective view of a representative outboard motor frame showing the drive shaft frame, the motor assembly mounting apertures, the boat transom bracket, and one of the two exemplary mount assemblies of the present invention installed within one of the two mount assembly fittings of the outboard motor frame.
Figure 2:
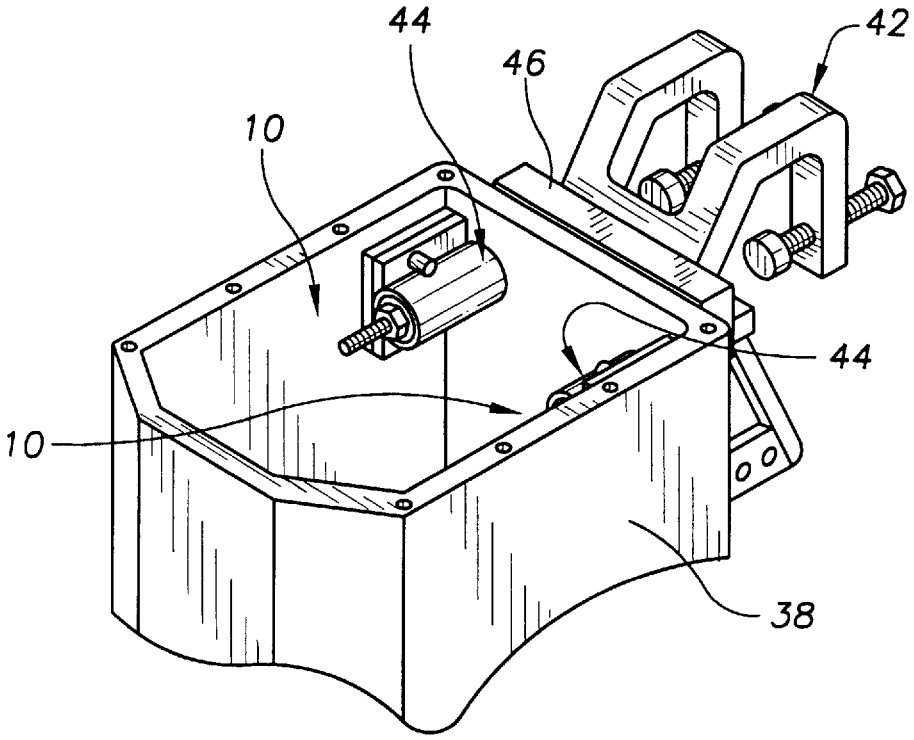
FIG. 2 is a detail perspective view of the two mount assemblies of FIG. 1A each installed within one of the two mount assembly fittings of the outboard motor frame, the boat transom bracket including the bracket attachment plate, the top portion of the drive shaft frame, and the eight motor assembly mounting apertures.

Referring now to FIG. 1A, mounting assembly 10 (FIG. 1) is used in connection with an outboard motor frame, generally designated 36; having a drive shaft frame 38; a number of motor assembly mounting apertures 40; a boat transom bracket, generally designated 42; and two mount assembly fittings, generally designated 44 (FIG. 2). With reference to FIG. 2, in this embodiment, two mount assemblies 10 are used to secure an attachment plate 46 of boat transom bracket 42 to drive shaft frame 38.

Figure 3:
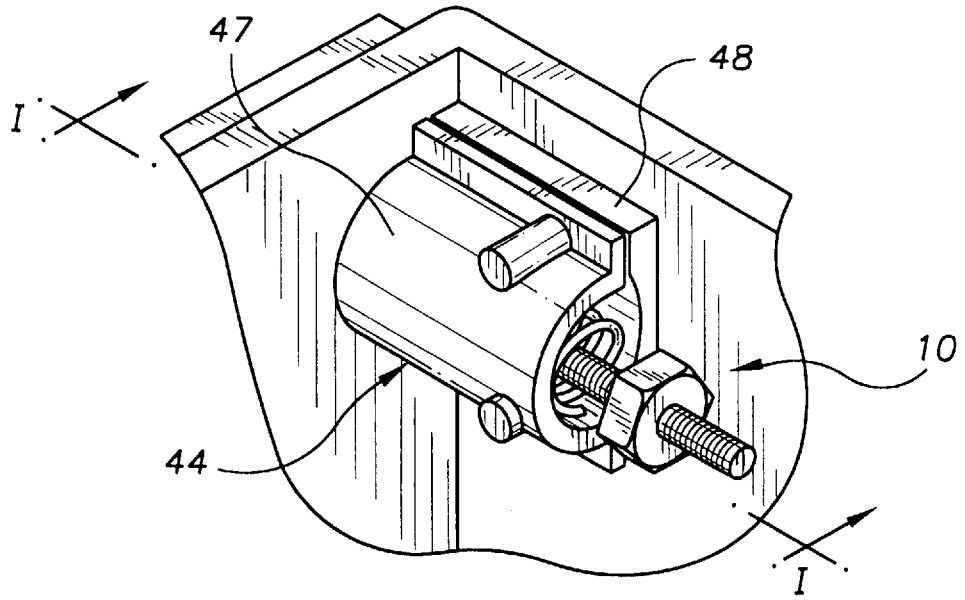
FIG. 3 is a detail perspective view of one of the two identical mount assembly fittings of the outboard motor frame including the bolt on fitting cover and the channeled fitting plate, and one of the exemplary mount assemblies installed within the mount assembly fitting.
Figure 4:
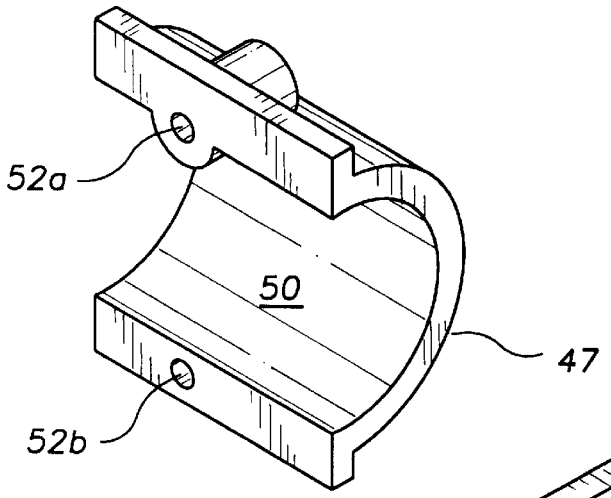
FIG. 4 is a perspective view of one of the bolt on fitting covers in isolation showing the cover channel and the two opposed, internally threaded attachment structures that each partially protrude into the cover channel.
Figure 5:
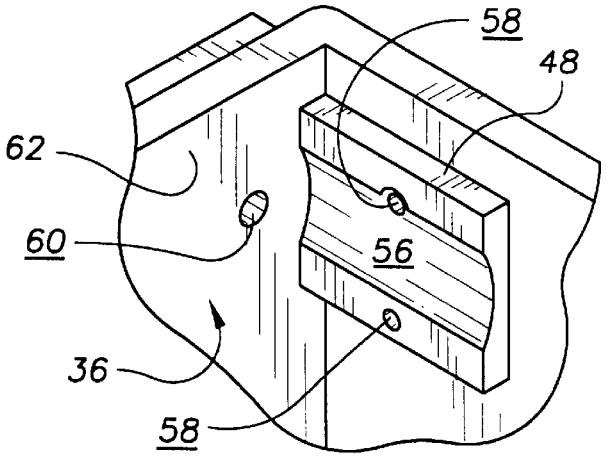
FIG. 5 is a detail perspective view showing the exemplary channeled fitting plate of FIG. 3 welded to the interior sidewall of the outboard motor frame, the two cover bolt apertures formed through the channeled fitting plate and the sidewall of the outboard motor frame, and the mounting bolt aperture formed through the rear sidewall of the outboard motor frame.

With reference now to FIG. 3, each mount assembly 10 is partially positioned within one of the two identical mount assembly fittings 44. Each mount assembly fitting 44 includes a bolt on fitting cover 47 and a channeled fitting plate 48. With reference to FIG. 4, bolt on fitting cover 47 includes a cover channel 50 formed therein and two opposed, internally threaded attachment structures 52*a*,52*b*. One attachment structure 52*a* protrudes into cover channel 50 and in use interlocks with the locking groove 34 (FIG. 1) that are formed into the exterior surface outer bushing 22 (FIG. 1). Bolt on fitting cover 47, with reference now to FIG. 5, is bolted to channeled fitting plate 48 to form the fitting as shown in FIG. 3. Channeled fitting plate 48 includes a channel 56 that is curved to receiving a portion of outer busing 22 (FIG. 1) and two cover bolt apertures 58 that are positioned to be simultaneously alignable with the protruding, internally threaded attachment structure 52*a* of fitting cover 47 (FIG. 4). In this embodiment, two mounting bolt apertures 60 are formed through the rear sidewall 62 outboard motor frame 36.

Figure 6:
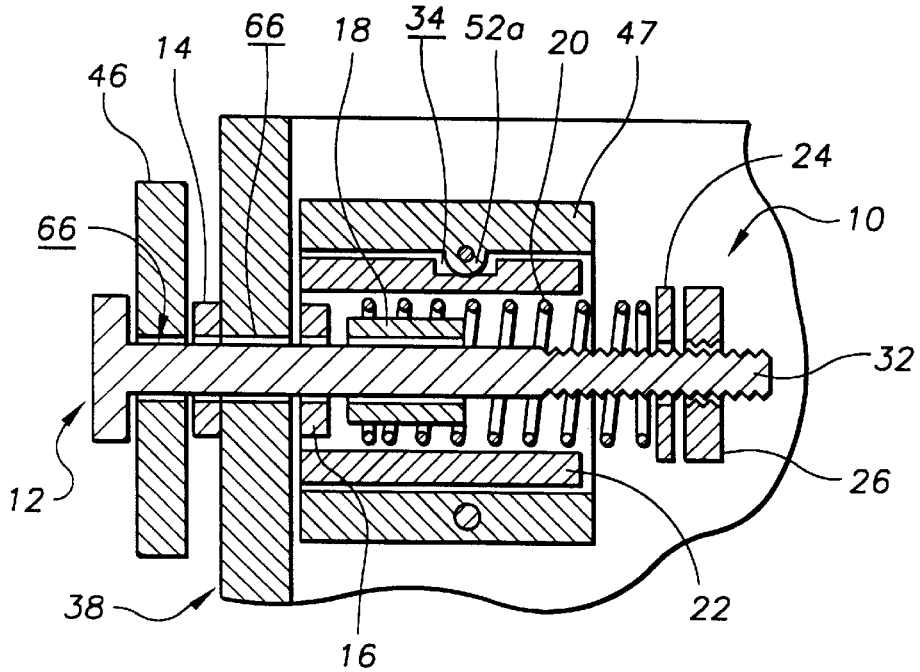
FIG. 6 is a cross sectional view of the mount assembly fitting and mount assembly of FIG. 3 through the line I—I showing the mounting bolt aperture formed through the rear sidewall of the outboard motor frame; one of the mounting apertures formed through the bracket attachment plate of the boat transom bracket; the bolt on fitting cover including the two opposed attachment structures; the two fitting cover attachment bolts; the threaded mounting bolt; the transom washer; the frame washer; the interior tubular bushing; the compression spring; the outer bushing with the locking groove; the spring compression washer; and the mounting nut.

With reference to FIG. 6, installation of each mounting assembly 10 is accomplished by inserting threaded end 32 of mounting bolt 12 sequentially through one of two holes 66 provided through attachment plate 46 of boat transom bracket 42 (FIG. 2); transom washer 14; mounting bolt aperture 66; frame washer 16; interior tubular bushing 18; compression spring 20; outer bushing 22; spring compression washer 24; and mounting nut 26. Outer bushing 22 is seated within cover channel 50 (FIG. 4) of fitting cover 47 with attachment structure 52*a* seated within the locking groove 34 of outer bushing 22. Mounting nut 26 is tightened sufficiently to cause compression spring 20 to compress and resiliently secure drive shaft frame 38 (Also shown in FIG. 2) to boat transom bracket 42 (FIG. 2). The all metal construction of mounting assembly 10 provides a mounting assembly with no rubber or plastic parts that can become degraded through exposure to gasoline or oil. In addition because mounting assembly 10 includes no rubber or plastic parts that can become degraded through exposure to gasoline or oil, mounting assembly 10 is more durable.

It can be seen from the preceding description that a mount assembly for an outboard motor frame of the type that includes two mount assembly fittings each having a bolt on fitting cover and a channeled fitting plate has been provided that does not include any plastic or rubber parts; that is durable; and that includes a threaded mounting bolt having a bolt shaft having a threaded end, an interior tubular bushing having a shaft passageway sized to receive a portion of the bolt shaft, a helically coiled compression spring of a length longer than the interior tubular bushing and sized to pass over the interior tubular bushing, an outer bushing having a bushing passageway having a bushing passageway diameter sufficient to allow the compression spring to be positioned into the bushing passageway and an exterior bushing diameter sized to allow the outer bushing to fit into the mount assembly fitting, the outer bushing having a locking groove formed into the exterior thereof, a spring compression washer having a washer diameter less than the bushing passageway diameter and a center washer hole sized to allow passage of the bolt shaft, and a mounting nut companionately threaded to thread onto the threaded end of the bolt shaft.

It is noted that the embodiment of the mount assembly for an outboard motor frame described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A mount assembly for an outboard motor frame that includes two mount assembly fittings each having a bolt on fitting cover and a channeled fitting plate, the mount assembly comprising:

a threaded mounting bolt having a bolt shaft having a threaded end;

an interior tubular bushing having a shaft passageway sized to receive a portion of said bolt shaft;

a helically coiled compression spring of a length longer than said interior tubular bushing and sized to pass over said interior tubular bushing;

an outer bushing having a bushing passageway having a bushing passageway diameter sufficient to allow said compression spring to be positioned into said bushing passageway and an exterior bushing diameter sized to allow said outer bushing to fit into said mount assembly fitting, said outer bushing having a locking groove formed into an exterior bushing surface thereof;

a spring compression washer having a washer diameter less than said bushing passageway diameter and a center washer hole sized to allow passage of said bolt shaft; and a mounting nut companionately threaded to thread onto said threaded end of said bolt shaft.

2. The mount assembly for an outboard motor frame of claim 1 further including:

a frame washer identical in size to said spring compression washer.

3. The mount assembly for an outboard motor frame of claim 1, wherein:

said outer bushing is constructed from stainless steel.

4. The mount assembly for an outboard motor frame of claim 1 wherein:

said interior tubular bushing is constructed from stainless steel.

5. The mount assembly for an outboard motor frame of claim 1 further including:

a transom washer identical in size to said spring compression washer.

6. The mount assembly for an outboard motor frame of claim 1, wherein:

said locking groove is machined into said exterior bushing surface.

7. The mount assembly for an outboard motor frame of claim 6, wherein:

said outer bushing is constructed from stainless steel.

8. The mount assembly for an outboard motor frame of claim 7 wherein:

said interior tubular bushing is constructed from stainless steel.

9. The mount assembly for an outboard motor frame of claim 8 further including:

a transom washer identical in size to said spring compression washer.

10. The mount assembly for an outboard motor frame of claim 9 further including:

a frame washer identical in size to said spring compression washer.

11. The mount assembly for an outboard motor frame of claim 8 further including:

a frame washer identical in size to said spring compression washer.

12. The mount assembly for an outboard motor frame of claim 7 further including:

a transom washer identical in size to said spring compression washer.

13. The mount assembly for an outboard motor frame of claim 7 further including:

a frame washer identical in size to said spring compression washer.

14. The mount assembly for an outboard motor frame of claim 6 wherein:

said interior tubular bushing is constructed from stainless steel.

15. The mount assembly for an outboard motor frame of claim 14 further including:

a transom washer identical in size to said spring compression washer.

16. The mount assembly for an outboard motor frame of claim 14 further including:

a frame washer identical in size to said spring compression washer.

17. The mount assembly for an outboard motor frame of claim 6 further including:

a transom washer identical in size to said spring compression washer.

18. The mount assembly for an outboard motor frame of claim 6 further including:

a frame washer identical in size to said spring compression washer.

* * * * *